United States Patent [19]

Darrow

[11] 4,017,210

[45] Apr. 12, 1977

[54] LIQUID-COOLED TURBINE BUCKET WITH INTEGRAL DISTRIBUTION AND METERING SYSTEM

[75] Inventor: Kenneth A. Darrow, Sprakers, N.Y.

[73] Assignee: General Electric Company, Schenectady, N.Y.

[22] Filed: Feb. 19, 1976

[21] Appl. No.: 659,576

[52] U.S. Cl. ..... 416/97 R; 416/95

[51] Int. Cl.[2] ..... F01D 5/18

[58] Field of Search ..... 416/95–97; 415/115, 116

[56] References Cited

UNITED STATES PATENTS

| | | | |
|---|---|---|---|
| 3,446,481 | 5/1969 | Kydd | 416/96 |
| 3,658,439 | 4/1972 | Kydd | 416/97 |
| 3,804,551 | 4/1974 | Moore | 416/97 |
| 3,844,679 | 10/1974 | Grondahl et al. | 416/97 |
| 3,849,025 | 11/1974 | Grondahl | 416/97 |
| 3,856,433 | 12/1974 | Grondahl et al. | 416/97 |
| 3,936,227 | 2/1976 | Wojcik | 416/95 |

*Primary Examiner*—Everette A. Powell, Jr.
*Attorney, Agent, or Firm*—John Swiatocha; Joseph T. Cohen; Jerome C. Squillaro

[57] ABSTRACT

Unitary turbine bucket construction equipped for liquid cooling thereof independently of other rotor-mounted liquid distribution or metering means is disclosed. The unitary construction comprises an airfoil-shaped core portion (with skin); a platform portion (with skin); a shank portion and a root portion; a plurality of first coolant passages beneath the skin on the pressure and suction faces of the core portion; a plurality of second coolant passages disposed beneath the skin in the platform portion and interconnected with the first coolant passages on a one-to-one basis as sets of coolant passages; a plurality of arcuate gutters integral with the bucket construction located radially inward of the core portion at the leading and trailing edges of the bucket, and holes extending through the gutters in the generally radial direction with each of said holes being in flow communication with a separate one of the sets of coolant passages.

12 Claims, 3 Drawing Figures

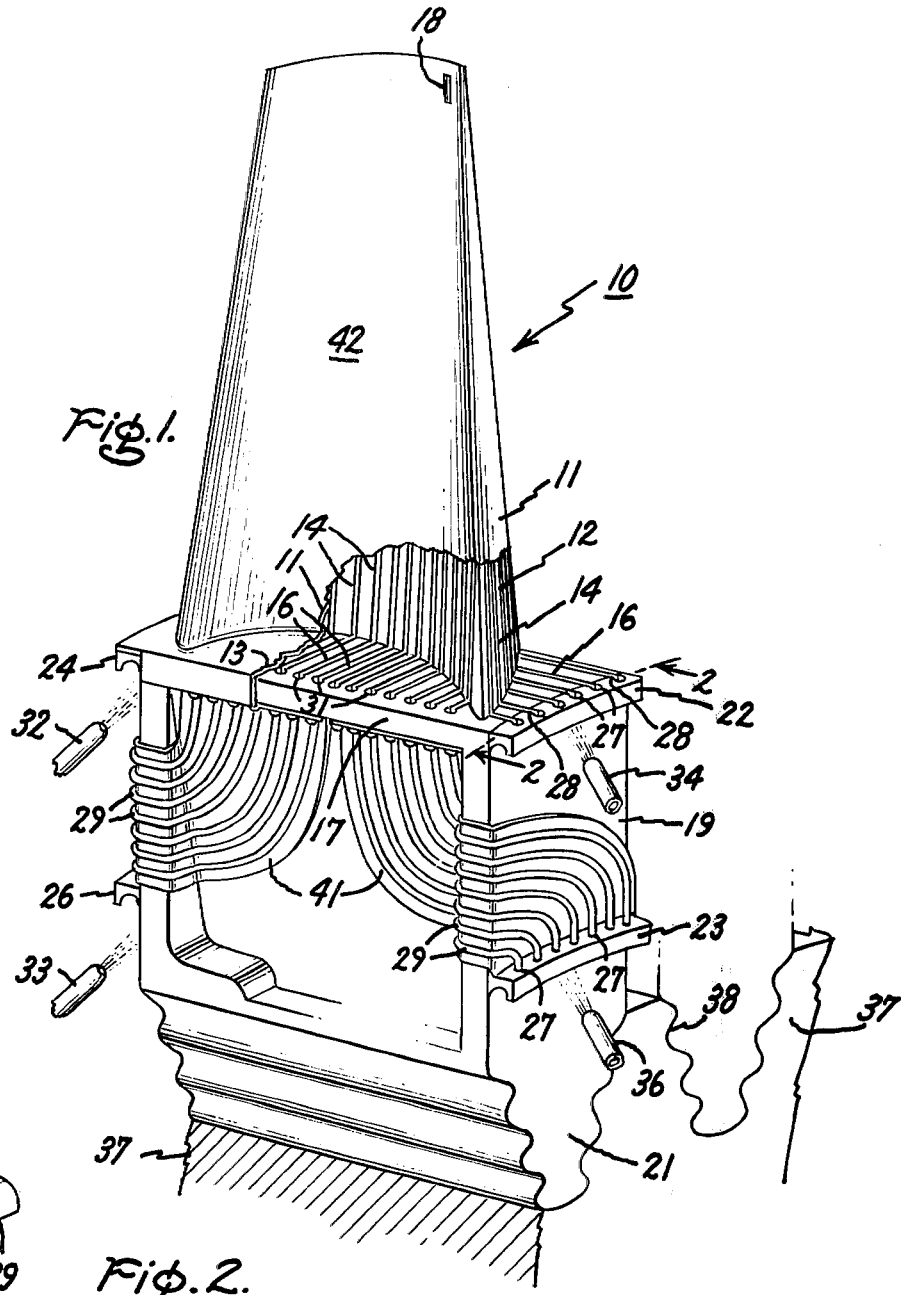
Fig. 1.
Fig. 3.
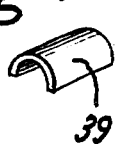
Fig. 2.
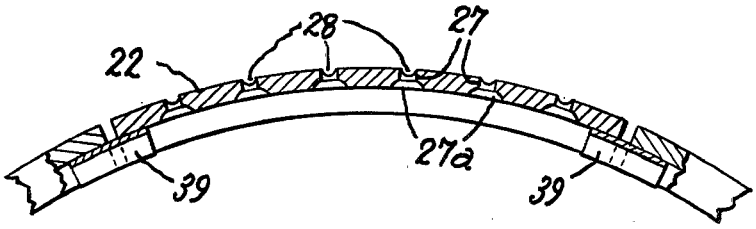

LIQUID-COOLED TURBINE BUCKET WITH INTEGRAL DISTRIBUTION AND METERING SYSTEM

BACKGROUND OF THE INVENTION

Structural arrangements for the open-circuit liquid cooling of gas turbine vanes are shown in U.S. Pat. No. 3,446,481 — Kydd. The cooling of the vanes is accomplished by means of a large number of spanwise-extending subsurface cooling channels. Arrangements for metering liquid coolant to such cooling channels are shown in U.S. Pat. No. 3,658,439 — Kydd, in U.S. Pat. No. 3,804,551 — Moore, and in U.S. Pat. No. 3,856,433 — Grondahl et al. Each of these disclosures of liquid metering employs some sort of axially-extending wier construction to accomplish the metering function.

The use of serpentine cooling channel construction for open-circuit liquid cooling of turbine vanes and platforms is disclosed in U.S. Pat. No. 3,844,679 — Grondahl et al. and U.S. Pat. No. 3,849,025 — Grondahl. In each of the latter two patents each convoluted cooling channel is fed liquid coolant directly from a gutter integral with the rotor via a coolant supply conduit.

In each of the aforementioned patents, rotor-mounted liquid distribution or metering means is required. Each of these patents is incorporated by reference.

Both the construction and maintenance of liquid-cooled turbines would be simplified by the utilization of unitary turbine bucket construction equipped for liquid cooling in which the bucket is completely independent of any other rotor-mounted liquid distribution or metering means. It is to this improved construction that the instant invention is directed.

DESCRIPTION OF THE INVENTION

Unitary turbine bucket construction equipped for liquid cooling thereof independently of other rotor-mounted liquid distribution or metering means is disclosed. The unitary construction comprises an airfoil-shaped core portion (with skin to form a vane); a platform portion (with skin); a shank portion and a root portion; a plurality of first coolant passages beneath the skin on the pressure and suction faces of the core portion; a plurality of second coolant passages disposed beneath the skin in the platform portion and interconnected with the first coolant passages on a one-to-one basis as sets of coolant passages; a plurality of arcuate gutters integral with the bucket construction located radially inward of the core portion at the leading and trailing edges of the bucket, and holes extending through the gutters in the generally radial direction with each of said holes being in flow communication with a separate one of the sets of coolant passages.

BRIEF DESCRIPTION OF THE DRAWING

The features of this invention believed to be novel and unobvious over the prior art are set forth with particularity in the appended claims. The invention itself, however, as to the organization, method of operation, and objects and advantages thereof, may best be understood by reference to the following description taken in conjunction with the accompanying drawing wherein:

FIG. 1 is a three-dimensional view partially cut away showing a preferred embodiment of a unitary turbine bucket constructed in accordance with this invention;

FIG. 2 is a section taken along line 2—2 of FIG. 1 setting forth the means by which each gutter distributes coolant received thereby and would interconnect with gutters to be located circumferentially adjacent thereto; and FIG. 3 is a three-dimensional view of removable means for accomplishing such interconnection.

MANNER AND PROCESS OF MAKING AND USING THE INVENTION

The embodiment described hereinbelow is the best mode contemplated of this invention.

Metal skin 11 providing the airfoil configuration for bucket 10 is shown cut away to expose a portion of each of the pressure and suction faces of airfoil-shaped bucket core 12. Similarly, metal skin 13 providing the surface for platform portion 17 is cut away to show the arrangement in sets of the coolant passages 14, 16 recessed in bucket core 12 and platform 17, respectively, on a one-to-one basis. At the radially outer ends of coolant passages 14, these passages are preferably in flow communication with, and terminate at, a manifold (not shown) from which coolant would be discharged from the bucket via trailing edge vent 18.

In addition to the airfoil-shaped core portion 12, bucket 10 comprises platform portion 17, shank portion 19 and root portion 21. Integral with bucket 10 are arcuate-shaped gutters 22, 23, 24, 26. In the arrangement shown, gutters 22 and 24 are extensions of platform 17 located at the trailing and leading edges thereof, respectively. Gutters 23 and 26 are integral with or affixed to the trailing and leading edges, respectively, of shank 19.

The radially outer wall of each arcuate gutter has holes 27 extending therethrough from the radially inner coolant-receiving surfaces thereof and each of these holes 27 is in flow communication with a single set of coolant passages 14, 16 either via interconnecting passages 28 (for gutters 22 and 24) or via interconnecting tubes 29 and holes 31 through platform 17 (for gutters 23 and 26).

Thus, in operation, cooling liquid (usually water) is sprayed at low pressure in a generally radially outward direction from two tiers of nozzles (e.g., nozzles 32, 33 and 34, 36) located on each side of rotor disk 37 on which buckets 10 are mounted with the root portions 21 thereof engaged in slots 38.

A multiplicity of stationary nozzles in each tier continually deposit cooling liquid into the plurality of gutter structures provided on each bucket as the given bucket is rotated thereby. Gutter coolant-receiving surface continuity is provided from each gutter on a given bucket to gutters located circumferentially adjacent thereto by the provision of removable interconnecting means, which prevent liquid from leaving the gutters through the small gaps between adjacent buckets.

One example of suitable removable interconnecting means is shown in FIGS. 2 and 3. As shown, connector 39 having an inner surface approximating the coolant-receiving surface portion of each gutter is snapped into place into a recess of appropriate dimension. These devices are readily removed in the event it becomes necessary to replace any given bucket 10. After a new bucket 10 is properly mounted in place, interconnecting means 39 are readily set in place and provide a continuous annular surface for each of the four gutters shown.

The cooling liquid received in each of the gutters drains into one or the other of holes 27, and, having done so, enters a continuous path from the point of entry into a given hole 27. In the preferred construction shown in FIG. 2, recessed pockets 27*a* are provided to facilitate entry of coolant into holes 27. Each hole 27 connects with a given set of coolant passages 16, 14 for transit of coolant under skins 13 and 11 in a spanwise direction to empty into manifold means (not shown) near the tip of the bucket and be discharged from opening 18 adjacent the trailing edge.

It is more convenient to locate the radially outer pair of gutters 22, 24 as an extension of platform 17, but it is also feasible to extend the leading and trailing edges of the platform and dispose these gutters under the overhang.

The internal diameter of tubes 29 would be relatively small, ranging from about 30 to 60 mils. These tubes are shown affixed to a thin metal sheet 41 whereby the sheet 41 and tubes 29 comprise a preformed harness with the requisite bends to fit closely, as shown, around portions of the shank 19 and underside of platform 17. During assembly, when these harnesses have been properly located so that each tube 29 is mated at one end with a hole 27 and at the other end with a hole 31, all connections can be made in a single brazing cycle. The basic turbine bucket structure itself (airfoil-shaped core, platform, shank and root portions) is made by investment casting as generally described in U.S. Pat. No. 3,678,987 — Kydd. As may be seen, all holes and passageways required are readily formed either in the casting operation or by machining (e.g., electrical discharge machining) of the casting.

With the arrangement shown, arcuate-shaped gutter 22 via holes 27 and passage 28 provide the requisite coolant for about one-half the sets presenting coolant passages on the suction side of bucket 10. Similarly, arcuate-shaped gutter 24 provides coolant to the other half of the sets presenting coolant passages to service the suction face of vane 42. The same sort of division of sets of coolant passages is accommodated on the pressure face of vane 42 by arcuate-shaped gutters 23 and 26.

Thus, a unitary turbine bucket construction has been disclosed fully equipped for liquid cooling independently of any other rotor-mounted liquid distribution or metering means. This unitary construction considerably simplifies manufacture of the turbine rotor and greatly enhances the maintainability of the turbine structure by the fact that any defect (other than in nozzle operation) in the liquid distribution or metering means is contained on the given bucket, which is readily replaceable.

Another important advantage of this invention is the provision for a plurality of gutters making it possible to accommodate a large number (e.g., as many as 100) of coolant-receiving holes to meter coolant to a similarly large number of coolant passage sets. This capability is a requisite, when the vane coolant passages are disposed spanwise.

What I claim as new and desire to secure by Letters Patent of the United States is:

1. Turbine bucket construction having a leading edge and a trailing edge comprising in combination:

integrally formed airfoil-shaped core, platform, shank and root portions;

a plurality of first coolant passages extending along the pressure and suction faces of said core portion;

a plurality of second coolant passages in said platform portion, each of said second coolant passages being connected at one end thereof to a separate one of said first coolant passages as a set;

skin material disposed over the upper surface of said platform portion and over said core portion;

a first pair of arcuate gutters as an integral part of said bucket construction with one of said gutters in said first pair projecting from the leading edge of said bucket and the other of said gutters in said first pair projecting from the trailing edge of said bucket, both of said gutters in said first pair being located radially inward of said core portion;

a second pair of arcuate gutters integral with said shank portion with one of said gutters in said second pair being disposed at each end of said shank portion, the centers of the radii of curvature of all gutters lying on a common axis; and each of said gutters having at least one hole extending therethrough in the generally radial direction, each of said holes being in flow communication with a separate one of said sets of coolant passages whereby each of said holes will meter the flow of liquid coolant to the set of coolant passages with which it is in flow communication and each of said gutters can be made to supply a different amount of liquid coolant to the holes extending therethrough.

2. The turbine bucket construction recited in claim 1 wherein provision is made at the ends of each gutter for receiving removable means for interconnecting each gutter with gutters to be located circumferentially adjacent thereto upon the disposition of buckets on either side thereof in the turbine rotor.

3. The turbine bucket construction recited in claim 1 wherein the holes through the first pair of arcuate gutters are in flow communication with the group of sets of coolant passages having the first coolant passages thereof disposed on the suction face of the airfoil-shaped core portion, each gutter accommodating about one-half of said group.

4. The turbine bucket construction recited in claim 1 wherein the holes through the second pair of arcuate gutters are in flow communication via interconnecting tubes with the group of sets of coolant passages having the first coolant passages thereof disposed on the pressure face of the airfoil-shaped core portion, each gutter accommodating about one-half of said group.

5. The turbine bucket construction recited in claim 4 wherein the tubes leading from each gutter are affixed to a metal support sheet, said sheet being affixed at least to the shank portion and said sheet and tubes comprising a prefabricated harness.

6. The turbine bucket construction recited in claim 1 wherein the root portion has a dovetailed configuration.

7. The turbine bucket construction recited in claim 1 wherein the first coolant passages are recessed into the pressure and suction faces of the airfoil-shaped core portion.

8. The turbine bucket construction recited in claim 1 wherein each gutter is formed with at least one depression in the surface thereof, each depression being at the location of a hole extending through the gutter.

9. The turbine bucket construction recited in claim 1 wherein the first coolant passages extend in the spanwise direction along the pressure and suction faces of the core portion.

10. The turbine bucket construction recited in claim 1 wherein the first pair of gutters are integral with the platform portion.

11. The turbine bucket construction recited in claim 1 wherein the radii of curvature of the first pair of gutters are equal.

12. The turbine bucket construction recited in claim 1 wherein the radii of curvature of the second pair of gutters are equal.

* * * * *